United States Patent [19]

Carter, III et al.

[11] Patent Number: 4,695,058

[45] Date of Patent: Sep. 22, 1987

[54] SIMULATED SHOOTING GAME WITH CONTINUOUS TRANSMISSION OF TARGET IDENTIFICATION SIGNALS

[75] Inventors: George A. Carter, III, Dallas; James L. Dooley, Arlington, both of Tex.

[73] Assignee: Photon Marketing Limited, Dallas, Tex.

[21] Appl. No.: 822,966

[22] Filed: Jan. 28, 1986

Related U.S. Application Data

[63] Continuation of Ser. No. 575,332, Jan. 31, 1984, abandoned.

[51] Int. Cl.[4] ..... F41J 5/00

[52] U.S. Cl. ..... 273/311; 434/16; 434/22; 273/313

[58] Field of Search ..... 273/310–316; 434/21–22

[56] References Cited

U.S. PATENT DOCUMENTS

| | | | |
|---|---|---|---|
| 3,083,474 | 4/1963 | Knapp | 35/25 |
| 3,104,478 | 9/1963 | Strauss et al. | 35/25 |
| 3,294,401 | 12/1966 | Nicholas et al. . | |
| 3,434,226 | 3/1969 | Schaller | 35/25 |
| 3,466,761 | 9/1969 | Stinchcomb | 35/25 |
| 3,657,826 | 4/1972 | Marshall et al. | 35/25 |
| 3,749,924 | 7/1973 | Vischulis . | |
| 3,847,396 | 11/1974 | Ashford | 273/101.1 |
| 3,898,747 | 8/1975 | Marshall | 35/25 |
| 3,950,862 | 4/1976 | Shciel et al. | 35/25 |
| 3,964,178 | 6/1976 | Marshall et al. | 434/22 |
| 4,063,368 | 12/1977 | McFarland et al. | 35/25 |
| 4,086,711 | 5/1978 | Gammarino et al. | 35/25 |
| 4,142,722 | 3/1979 | Romano et al. | 273/101.1 |
| 4,175,748 | 11/1979 | Yokoi . | |
| 4,352,665 | 10/1982 | Kimble et al. | 273/312 |
| 4,373,916 | 2/1983 | Ashford et al. | 434/22 |

FOREIGN PATENT DOCUMENTS

| | | |
|---|---|---|
| 0067654 | 12/1982 | European Pat. Off. . |
| 125294 | 4/1977 | Fed. Rep. of Germany . |
| 2952608 | 12/1979 | Fed. Rep. of Germany . |
| 2426479 | 5/1978 | France . |

*Primary Examiner*—Richard C. Pinkham
*Assistant Examiner*—Stuart W. Rose
*Attorney, Agent, or Firm*—Richards, Harris, Medlock & Andrews

[57] ABSTRACT

An amusement shooting game for play by a plurality of players (30, 40) wherein players (30, 40) shoot at each other while avoiding being shot at is provided. The players' (30, 40) equipment includes a vest module (46) and helmet (44) for generating and transmitting a coded signal uniquely identifying each player (30, 40). Each player further utilizes a gun (50) for receiving the transmitted coded signals transmitted by players (30, 40). A processing unit (74) is responsive to the gun (50) for detecting a transmitted coded signal. Data processing devices (126, 110, 114) are utilized for counting and displaying the number of detected coded signals to provide a score for each player representing the number of players (30, 40) he has shot during the play of the game.

31 Claims, 17 Drawing Figures

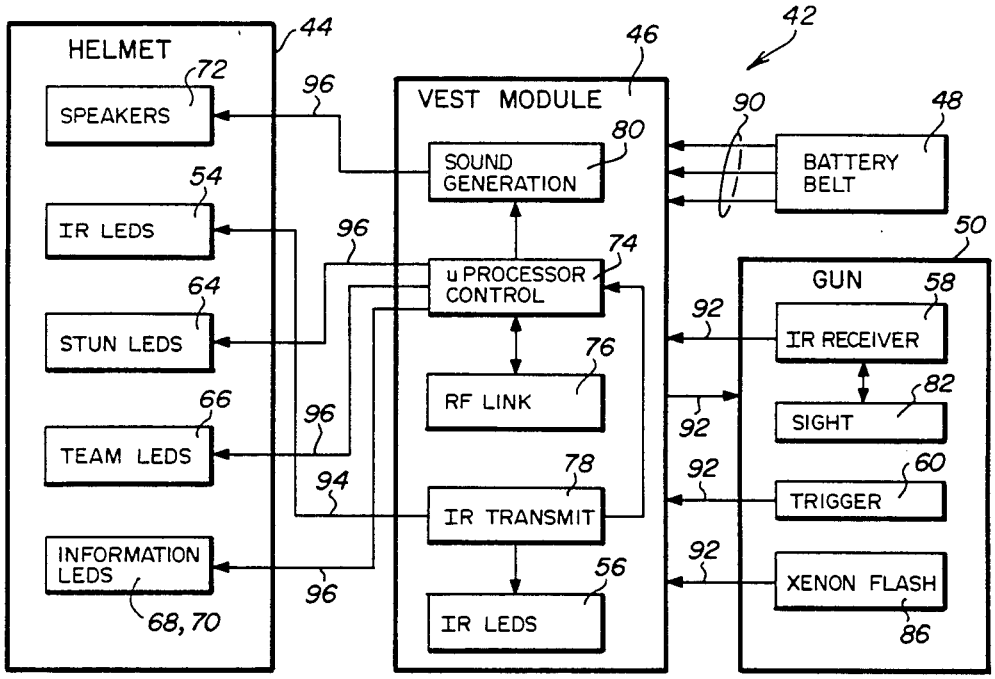
FIG. 2
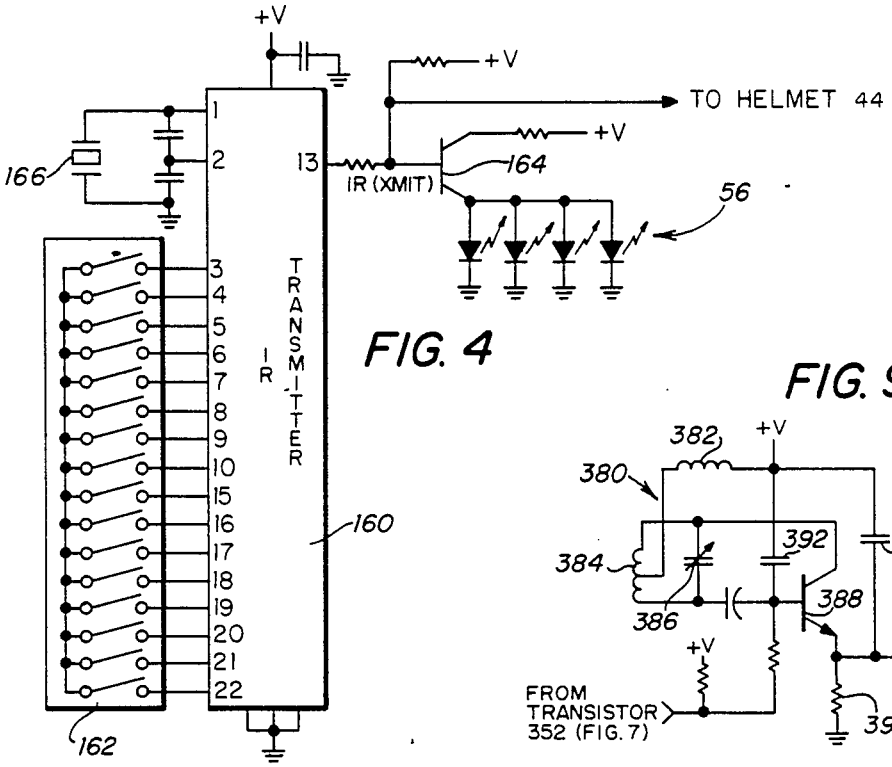
FIG. 4
FIG. 9
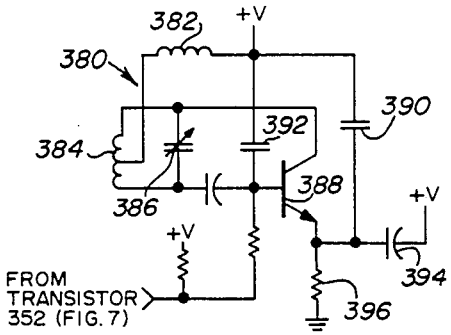

TO COUNTER 252
HELMET 44
1 SEC CLOCK 254
SOUND CIRCUIT 80
TEAM ID
STUN ID
RD XT
WR XT
XENON
CODE
HIT
SHOT
DECODER
282
RAM
260
ROM
270
274
272
280
262
284
TO COUNTER 252
CODE
292
290
IRSIG
XTAL OSC.
268
266
MULTIPLEX
258
256
M-CROPROCESSOR
250
257
FROM RF RCVR OUTPUT (FIG. 10)
1 SEC CLOCK
254
COUNTER
252
74
UART
350
352
RD XT
WR XT
TO RF XMITTER (FIG. 9)
IRSIG FROM IR RECEIVER 180 (FIG. 5)
FROM RF POLL
TRIGGER FROM TRANSISTOR 192 (FIG. 5)
294
+V

SIMULATED SHOOTING GAME WITH CONTINUOUS TRANSMISSION OF TARGET IDENTIFICATION SIGNALS

This application is a continuation of application Ser. No. 575,332, filed Jan. 31, 1984, now abandoned.

TECHNICAL FIELD

This invention relates to amusement games, and more particularly to a shooting type game in which players compete against each other in a battlefield type environment and where each player's score is compiled.

BACKGROUND ART

One of the earliest childhood played games involves some type of battle. Whether it be "good guys" against "bad guys", cowboys and indians or cops and robbers, a "shooter" and "target" theme prevails in these basic games. The variations on the shooting-type theme games are numerous, and are based upon the age level of the children involved as well as the sophistication of the equipment available for playing of the game. Guns may be anything from imaginary to realistic looking models of actual firearms. As children grow older, so does the sophistication of the game rules and game equipment.

With the technological advances in the electronics field, cowboy and indian shooting games have evolved into sophisticated audio visual games involving battles between planet inhabitants and alien invaders. A battle with the aliens is carried out on a cathode ray tube display in which the sole player controls a joystick or push-button in order to "fight" the enemy. With the advances in audio visual games, the one-on-one individual player interaction and much of the independence of player involvement and physical movement in fighting a battle has been lost. The player's ability to plot strategies, utilize the terrain to his best advantage and carry out tactical strategies in a battle have mostly been delegated to the computer of the audio visual game and not the player.

Although the sophistication of an audio visual game has appealed to many, there are still children of all ages that enjoy a game in which they can shoot at a moving target as well as becoming a target themselves. Such games involve much interaction between the players; however, it is rather subjective as to whether a player has actually shot a target. It is therefore difficult to know when a player has actually "won" the game and if so, by how much he has beaten the "enemy". Unlike the scoring of an audio visual game, points are not automatically accumulated for shooting robbers as they are for shooting aliens under computer control.

A need has thus arisen for a shooting type game involving the sophistication of an audio visual game yet the simplicity of a childhood "good guys" and "bad guys" game. Such a game must provide feedback to each of the players as to whether they have been shot and must also compile a score informing each player of the number of targets he has shot. Such a game must also provide for interaction with the playing field in the form of obstacles which must be negotiated by the players in their pursuit of the "enemy" and their score.

DISCLOSURE OF THE INVENTION

In accordance with the present invention, an amusement game is provided which combines the childhood enjoyment of a "cops and robbers" shooting game with the sophistication of an audio visual game.

In accordance with the present invention, an amusement shooting game is provided for play by a plurality of players on a battlefield wherein each player shoots at other players and tries to avoid being shot. Associated with each player is a generator for transmitting a coded signal uniquely identifying each player. Also associated with each player is a receiver for receiving transmitted coded signals being transmitted by the players. Each player also has game equipment which is responsive to the receiver for detecting a transmitted coded signal. The game player equipment further includes circuitry for indicating to a player that his transmitted coded signal has been detected by another player as well as indicating to each player that he has received a transmitted coded signal, transmitted by another player. The game further includes devices for counting the number of coded signals detected by a player indicative of a score for each player representing the number of players he has shot during the game.

In accordance with another aspect of the present invention, an amusement shooting game for play by a plurality of players on a battlefield wherein the players shoot at each other while avoiding being shot includes a vest worn by each player for generating coded signals unique to each player. Each player wears a helmet and vest which transmits the unique coded signals. Each player further operates a gun which, when actuated, receives the unique coded signal. A data processor is included in the game for generating a score for each player indicative of the number of players that each player has shot.

In accordance with another aspect of the present invention, an amusement shooting game is provided for play by a plurality of players, wherein the players shoot at each other while avoiding being shot on a battlefield, and wherein each of the players has personal equipment including a helmet, a vest and gun. Structure is provided in the player's vest for generating an infrared code uniquely identifying the player. Circuitry is interconnected to the player's vest and the player's helmet for transmitting the infrared code. Circuitry is further included in the player's gun for receiving infrared codes transmitted by the other players. Circuitry interconnects the player's gun to the player's vest for detecting a received infrared code upon actuation of the gun. A transmitter is included in the player's vest for transmitting information related to a received infrared code to a processing unit. The processing unit includes structure for receiving the transmitted data from the transmitter within the player's vest and for calculating a score for each player based upon the number of players he has shot and the number of times he has been shot by other players. The processing unit further includes structure for transmitting data to each player to provide an indication whether the player has been shot or whether the player has shot another player.

BRIEF DESCRIPTION OF THE DRAWINGS

For a more complete understanding of the present invention and for further advantages thereof, reference is now made to the following Detailed Description, taken in conjunction with the accompanying Drawings in which:

FIG. 2 is a block diagram illustrating the interconnection and function of the game players' personal equipment;

FIG. 4 is a schematic diagram of a vest module transmitter for use with the present invention;

FIG. 9 is a schematic diagram of the RF transmit circuitry;

DETAILED DESCRIPTION

Figure 1:
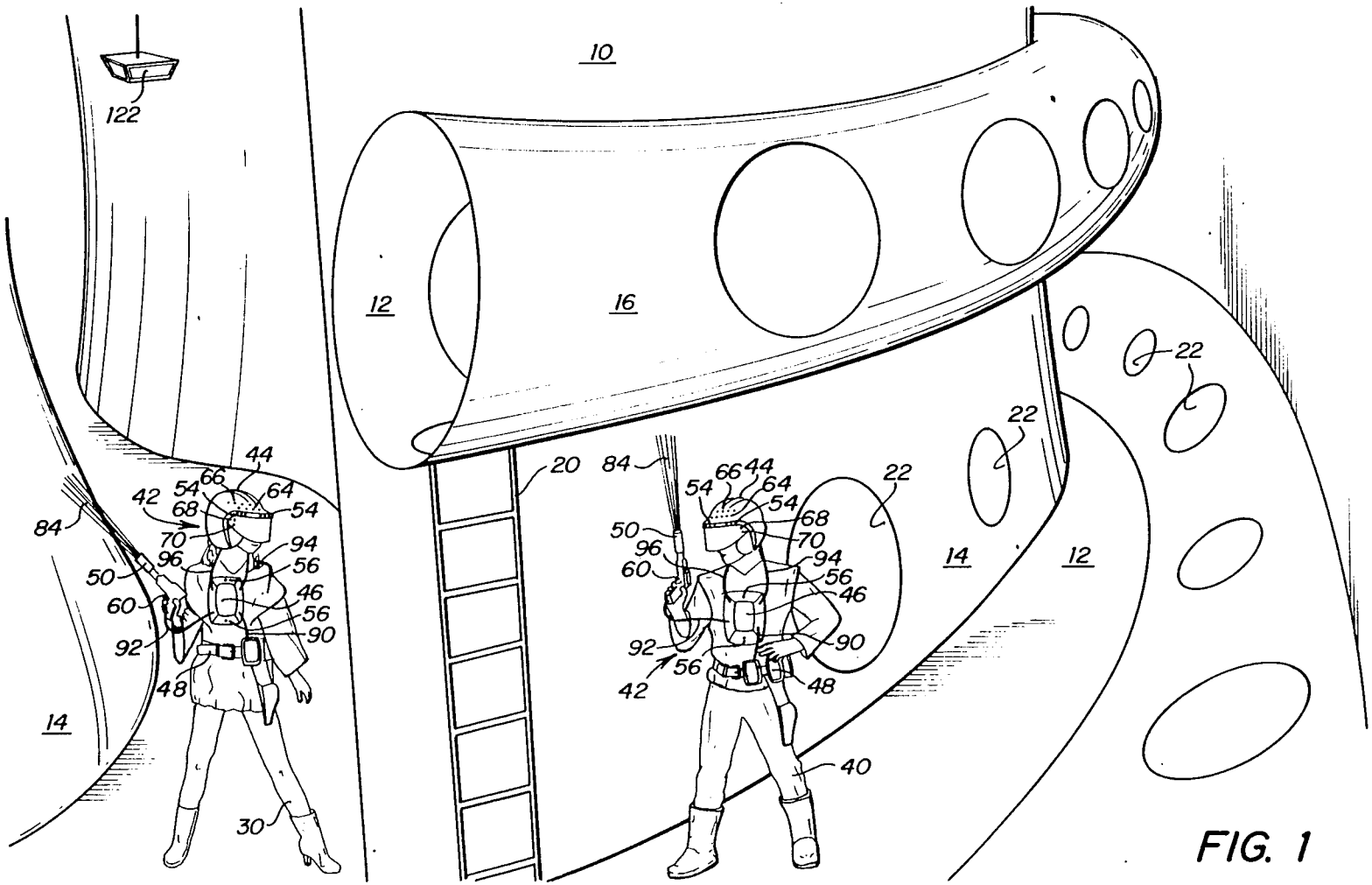
FIG. 1 is a diagrammatic illustration of a battlefield used for playing the present amusement game and illustrating two game players wearing their personal game equipment including a helmet, vest module, gun and battery belt.

Referring to FIG. 1, a diagrammatic illustration of the "battlefield" on which the present amusement game is played is illustrated. Battlefield 10 includes numerous paths 12 and obstacles 14 through which the players must negotiate to locate and hide from the "enemy". Battlefield 10 includes a tunnel 16 and multiple playing levels interconnected by a ladder 20. Additionally, doors 22 may be provided to provide connections between different parts of battlefield 10. Battlefield 10 may have a size of, for example, 70 feet by 100 feet.

Illustrated in FIG. 1 are two game players 30 and 40. Players 30 and 40 may be the sole players in the game or may be members of two competing teams consisting of from, for example, one to ten players. The personal equipment carried by players 30 and 40 is generally referred to by numeral 42. Since each player 30 and 40 can alternatively become the target of each other, either player 30 or player 40 can seek out the other player and fire to destroy the "enemy" or "target". However, the personal equipment 42 is basically identical for each player 30 and player 40 involved in the present game. Each player 30 and each player 40 of the game wears a helmet 44, a vest module 46 and a battery belt 48. Additionally, each player 30 and each player 40 has a weapon or gun 50. Battery belt 48 provides power for helmet 44, vest 46 and gun 50.

Although battlefield 10 illustrated in FIG. 1 and the game player's personal equipment 42 has been illustrated as having an "outer space" game motif, the present invention can be utilized with any type of character such as, for example, cowboys, indians, police, robbers or any other type of confronting factions with the mere change of the decor of the battlefield and costume design for the personal equipment 42 of the players. The "outer space" motif illustrated in FIG. 1 is for purposes of illustration only and not for limiting the scope of the present game.

Referring simultaneously to FIGS. 1 and 2, wherein like numerals are utilized for like and corresponding components, helmet 44 includes a plurality of infrared light emitting diodes (LEDs) 54. Infrared LEDs 54 transmit a pulse coded signal which is unique to each player 30 and 40. This same unique code is also transmitted via infrared LEDs 56 disposed on vest module 46. The unique code identifying a particular player 30 or 40 generated by infrared LEDs 54 and 56 is received by an infrared receiver 58 contained with gun 50 when gun 50 is "fired" by actuation of a trigger 60.

An important aspect of the present invention is the use of gun 50 as a receiving device rather than a transmitting device when a shot is "fired". By using gun 50 as a receiving device, the accuracy needed to "aim" the gun 50 is greater than that required had gun 50 been a transmitter where, in such instance, it would be easier to hit the target as the target got further away from a player 30 or 40 across battlefield 10 since the width of the beam transmitted would increase with distance from gun 50. By using gun 50 as a receiver, enemy players 30 or 40, can be "shot" in the range of 100 feet separating the players with sufficient accuracy to distinguish between which of a player 30 or 40 has been "shot". A further advantage of using gun 50 as a receiver is that only one receiver is needed, resulting in a more efficient control system. If gun 50 were a transmitter, multiple receivers would be necessary with separate controls.

A player 30 or 40 will be shot when an enemy player has sighted the player 30 or 40 with his gun 50 aimed at the player's helmet 44 or vest module 46 and trigger 60 of gun 50 is actuated to receive the sighted player's unique code transmitted by infrared LEDs 54 and 56. The transmission by infrared LEDs 54 and 56 provide a wide field for a player 30 or 40 to aim at in order to receive this signal.

Helmet 44 further includes a plurality of light emitting diodes 64 which are illuminated when a player 30 or 40 has been "shot". LEDs 64 remain illuminated for a predetermined period of time such as, for example, ten seconds, during which time the "shot" player is prevented from firing his gun 50. Light emitting diodes 66 are further provided in helmet 44 to identify teammates of a player 30 or 40. LEDs 66 may be colored red for one team and green for the second team. Additionally, helmet 44 and vest module 46 may include team colors. Additional light emitting diodes 68 and 70 provide information to a player 30 or 40 indicating that the player himself has been shot. Helmet 44 further includes a speaker 72 for providing audio battlefield sounds as well as for providing specific sounds indicating to a player 30 or 40 that he has been "shot" or has "hit" an enemy player or enemy target.

Vest module 46 includes a microprocessor control 74 which will subsequently be described with respect to FIG. 7. For the present, it will suffice to state that microprocessor control 74 functions to establish an interface between helmet 44 and gun 50 as well as for transmitting data between a player 30 and 40 to the computers of the present game. Transmission of this data is accomplished through an RF link circuit 76. Vest module 46 further includes infrared transmit circuitry 78 for selecting a unique code associated with each player 30 and 40 which is transmitted by infrared LEDs 54 and 56. The RF link circuit 76 will be subsequently described with respect to FIGS. 9 and 10 and the infrared transmit circuitry will be subsequently described with respect to FIG. 4. Vest module 46 further includes sound generation circuitry 80 for generating the sounds heard through helmet 44.

Gun 50, as previously stated, includes an infrared receiver 58 for receiving, when trigger 60 is actuated, the infrared signals transmitted by infrared LEDs 54 on helmet 44 and infrared LEDs 56 on vest module 46. Also provided on gun 50 is a sight 82 for visually indicating to a game player 30 or 40 that he is receiving a coded signal from an enemy player and that upon actuation of trigger 60 will have "shot" the enemy player. Also, upon actuation of trigger 60, a flash of light 84 will be emitted from gun 50 from a xenon flash circuit 86 to provide a visual indication that gun 50 has been fired. The flash 84 however, is not functional to determine whether a player 30 or 40 has been shot.

Battery belt 48 includes eighteen batteries, each battery providing, for example, six volts DC power for operation of helmet 44, vest module 46 and gun 50. The output of battery belt 48 is applied via a cable 90 to vest module 46. Gun 50 is interconnected to vest module 46 via a cable 92. Vest module 46 is interconnected to helmet 44 via a cable 94 for supplying power to infrared LEDs 54 and via a cable 96.

Figure 3:
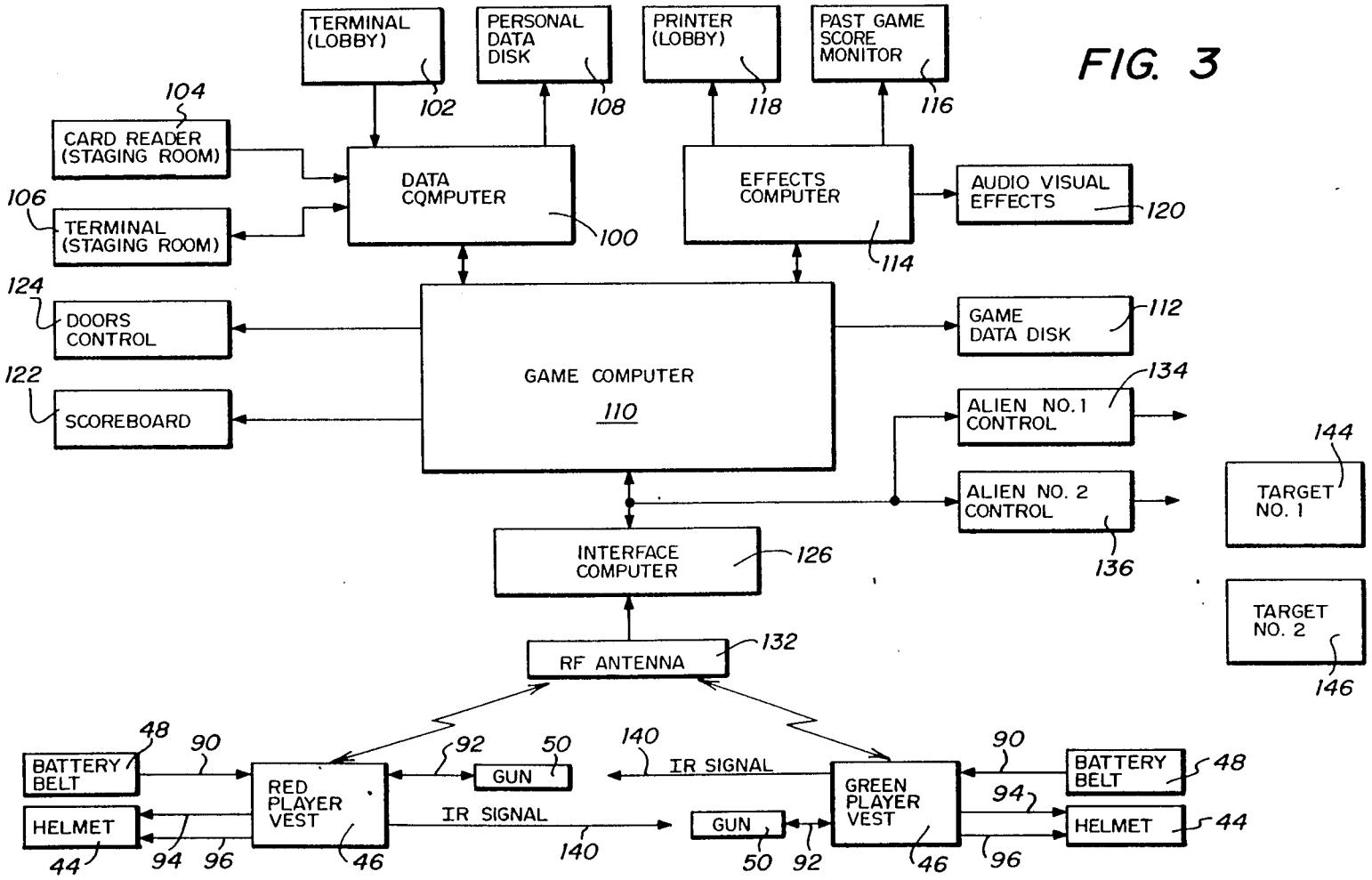
FIG. 3 is an electronic block diagram illustrating the operation of the present game's computers and interconnection with the game players' personal equipment.

Referring now to FIG. 3, a block diagram of the present game computers and personal equipment 42 is illustrated. The present amusement game includes a data computer 100. Interconnected to data computer 100 is a terminal 102 which may be positioned in the lobby of the amusement facility where the present game is being played, apart from battlefield 10. Terminal 102 includes a keyboard for inputting player name and identification information to data computer 100. Also interconnected to data computer 100 is a card reader 104 for reading the player identification number located on a player identification card having the personal code of a particular player. Card reader 104 may comprise for example, a bar code reader for reading a printed bar code on the player's identification card. Card reader 104 also reads a unique code associated with each vest module 46. Data computer 100 associates a particular player identification number with the particular vest module 46 code he will be wearing during a play of a game.

Also interconnected to data computer 100 is an input terminal 106 for manually inputting player identification and vest code module 46 numbers into data computer 100. Terminal 106 may also be utilized for making corrections of input data from card reader 104 and terminal 102. The information input to data computer 100 in the form of the player's names and identification codes will be stored on a data disk 108 on a day-to-day basis. Card reader 104 and terminal 106 may be physically located in a staging room where players 30 and 40 are "suited up" with their personal equipment 42. The staging room will be closer to battlefield 10 than the lobby area of the amusement facility.

The output of data computer 100 is also applied to a game computer 110 which places in the game computer 110 the players' name and personal code in addition to the vest module 46 code number the player will be wearing during a play of the game. Game computer 110 includes a real time clock calendar for controlling the length of a particular play of the present game and for tracking the scores of the players for each game played during a particular day. Score information for each player is maintained on a game data disk 112 interconnected to game computer 110. The game data disk 112 is removed at the end of each day's play, such that the results from each day can be compared and an overall ranking of the players' ability from one day to the next and from one location to the next can be compiled.

Game computer 110 also controls an effects computer 114. Effects computer 114 is interconnected to a past game score monitor 116 for displaying the results of the previously played game during the play of the present game. A player may also obtain a printed copy of his score which is printed on a printer 118 located in the lobby of the amusement facility. Printer 118 is also under the control of effects computer 114. Effects computer 114 also controls the audio and visual effects 120 present on battlefield 10, such as for example, controlling the intensity of lights, and presents sounds to numerous speakers located throughout battlefield 10.

Game computer 110 also displays the players' ongoing score during a play of the game on a scoreboard 122 which is displayed only during a play of the game. Game computer 110 also controls doors and other obstacles such as, for example, doors 22 (FIG. 1) through operation of a door control 124.

Game computer 110 is also interconnected to an interface computer 126 which is responsible for communication between a player 30 and 40 and game computer 110 using the vest codes of the players. Interface computer 126 communicates with vest module 46 through an RF receive-transmitter link contained with interface computer 126 and an RF antenna 132. Interface computer 126 also controls the start of a play of the present game.

Game computer 110 is also interconnected to alien number 1 control 134 and alien number 2 control 136. The aliens present on battlefield 10 provide obstacles for players 30 and 40. When actuated, the aliens will "shoot" any players 30 and 40 within their field of view during the time period for which the aliens are actuated. In effect, the aliens act as a third team on battlefield 10. At the end of the game, alien controls 134 and 136 transmit data, identifying which players 30 and 40 they have shot, to game computer 110. Alien number 1 control 134 and number 2 control 136 include infrared receivers for receiving the infrared codes transmitted by a players' helmet 44 and vest module 46. Alien control devices 134 and 136 are essentially infrared receivers similar to the gun 50 receivers of players and 40.

As previously stated, gun 50 contains an infrared receiver for receiving an infrared signal 140 generated by an opposing player's infrared transmitter contained within vest module 46. Gun 50 also includes electronic sight 82 which informs the player he is receiving a code from another player 30 or 40.

Also illustrated in FIG. 3 are targets 144 and 146 which comprise infrared transmitters which transmit a fixed code. Targets 144 and 146 may be shot at by a player 30 or 40 to obtain points much in the way a player may shoot at an enemy player; however, the points earned for shooting a target 144 and 146 are greater than the points earned for shooting an opposing player.

A suggested game format is as follows. Each team may consist of from one to ten players. The game playing time may be approximately 5 minutes. Each time a player "shoots" an enemy, two points are awarded to the player. If an enemy target 144 or 146 located at an enemy base is shot, 20 points may be awarded to the player who has shot the target. Points are deducted from a player's 30 or 40 score should a player shoot a team member. Three points may be deducted for this occurrence. A player will have for example, one point deducted from his score if shot by an opposing player. If a player is shot by an alien, 134 or 136, three points may be deducted from his score. Additionally, if the player attempts to enter a doorway 22 (FIG. 1) which has been previously closed, ten points, for example, may be deducted from his accumulated score.

The number of shots which a player may fire from his gun 50 may be limited to, for example, 20 per minute. The 20 shots may be made as rapidly as desired by actuating the trigger 60 (FIG. 2); however, when the 20 shot limit has been reached, gun 50 will be inoperative for a period of, for example, one minute. In the event a player's gun 50 is inoperative, LEDs 70 (FIG. 2) will be illuminated as well as LEDs 64 to indicate to the player having an inoperative gun 50 as well as all other players that his gun 50 is inoperative. When gun 50 is fired, sounds will be emitted through speaker 72 in helmet 44 of the firing player as well as a xenon flash 84 being emitted from gun 50.

When a player 30 or 40 is shot, there is an exploding sound emitted by speaker 72 in his helmet 44. Additionally, the team LEDs 66 (FIG. 2) will extinguish and LEDs 64 will become illuminated indicating that the player 30 or 40 has been shot. Further game formats may include the prohibition of a player 30 or 40 from consecutively shooting a particular player. For example, a player 30 must shoot several different players on the opposing enemy team before he can reshoot a same player.

Referring now to FIG. 4, infrared transmitter 78 of vest module 46 is illustrated. Infrared transmitter 78 includes an infrared transmitter integrated circuit 160 which may comprise for example, an SN76882N integrated circuit manufactured by Texas Instruments of Dallas, Tex. The particular code of each vest 46 of a player 30 or 40 is preselected by the setting of switches 162 which provide inputs to infrared transmitter 160. A possibility of 64 different codes may be selected through switches 162 for generation by infrared transmitter 160. The output of infrared transmitter 160 generates the IR (XMIT) signal applied to the base of a transistor 164 for actuating infrared light emitting diodes 56 on vest module 46. Circuitry related to infrared transmitter 160 includes a 455 KHz crystal 166 and additional components disclosed in Texas Instruments specification sheet dated September 1981 for operation of an SN76882N, which is incorporated herein by reference. Targets 144 and 146 include a similar infrared transmitters 160 for generating a fixed code utilizing an SN76882N integrated circuit.

Figure 5:
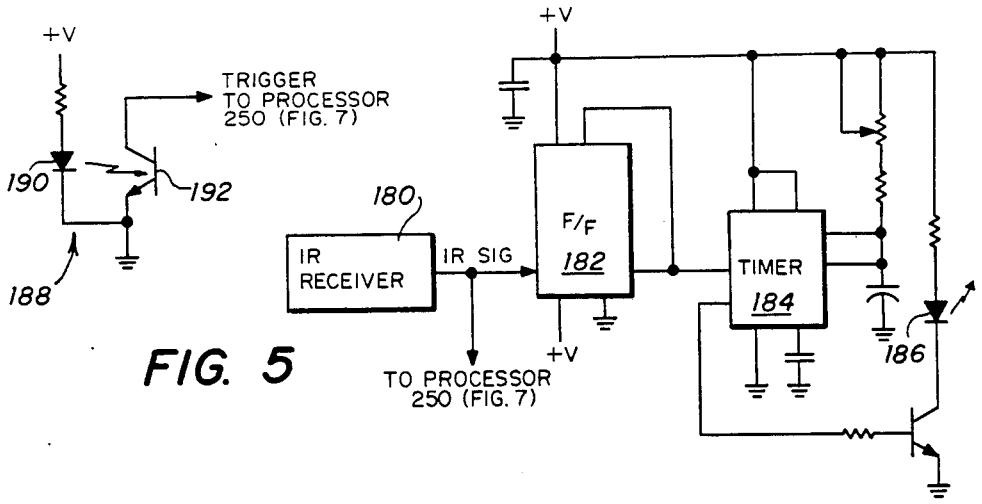
FIG. 5 is a schematic diagram of a gun receiver for use with the present invention.

Referring now to FIG. 5, a portion of the present electronic circuitry for gun 50 will now be described. Gun 50 comprises the receiver for the infrared codes generated by infrared transmitter 160 (FIG. 4) of vest module 46 which are transmitted by infrared LEDs 56 located on vest module 46 and infrared LEDs 54 located on helmet 44. By aiming gun 50 at an enemy player's helmet 44 and/or vest module 46 within about 100 feet, a player 30 or 40 is able to receive the unique code generated by an enemy player 30 or 40. Gun 50 includes an infrared receiver 180 which may comprise, for example, an SN76832AN integrated circuit manufactured by Texas Instruments of Dallas, Tex. The operation of an SN76832AN receiver is described more thoroughly in Texas Instruments specification sheet dated June 1981, which is incorporated herein by reference. The output by infrared receiver, IRSIG signal is transmitted to microprocessor control circuitry 74 of vest module 46 by cable 96 indicating that a unique code transmitted by player 30 or 40 has been received by an opposing player.

The IRSIG signal is also applied to a flip-flop 182 whose output is applied to a timer 184. The output of timer 184 is applied to a light emitting diode 186 which is the electronic sight 82 of gun 50. When a valid infrared code has been detected by IR receiver 180, LED 186 will be illuminated indicating to a player 30 or 40 that he has properly aimed at an opposing player and is receiving that player's code. Since the IRSIG signal is a pulsating type code, flip-flop 182 and timer 184 are utilized to generate a steady state signal for the constant illumination of LED 186 as long as the IRSIG signal is being received.

Additional circuitry located within gun 50 is an optointerrupter circuit generally identified by the numeral 188. Optointerrupter circuit 188 includes a light emitting diode 190 and a transistor 192. When the trigger of gun 50 is actuated, the beam between light emitting diode 190 and transistor 192 is interrupted, which allows the beam to impinge on transistor 192 to generate an interrupt signal to microprocessor control circuit 74 of vest module 46 via cable 96.

Figure 6:
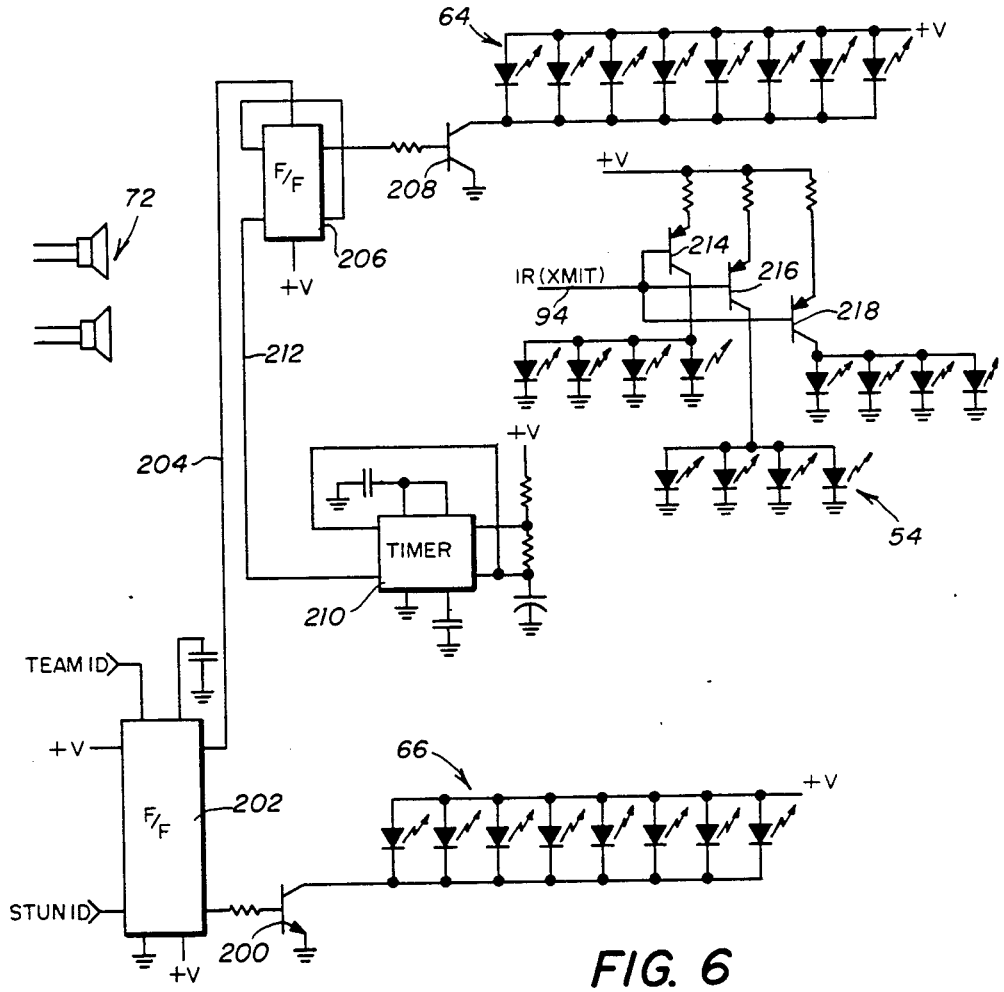
FIG. 6 is a schematic diagram of a helmet circuit for use with the present invention.

Referring now to FIG. 6, the electronic circuitry contained within helmet 44 is illustrated. Helmet 44 includes speakers 72 for presenting an audio indication to a player 30 or 40 that he has been shot, has successfully shot an enemy player and for creating battlefield sounds. As previously stated with respect to FIG. 2, helmet 44 includes eight team LEDs 66 which identify the team of a player 30 or 40 and may be illuminated in, for example, red or green colors. Team LEDs 66 are driven by a transistor 200 which, in turn is driven by a flip-flop 202. Flip-flop 202 receives as an input the TEAM ID signal generated by microprocessor control circuit 74 of vest module 46. The presence of the TEAM ID signal through operation of flip-flop 202 continuously illuminates team LEDs 66.

Flip-flop 202 also receives as an input the STUN ID signal generated by microprocessor control circuit 74 when a player 30 or 40 has been shot by an opposing player. The receipt of the STUN ID signal causes team LEDs 66 to turn off and causes flip-flop 202 to generate a signal via signal line 204 to a flip-flop 206. The output of flip-flop 206 is applied to a transistor 208 whose output is applied to stun LEDs 64. The illumination of stun LEDs 64 indicates to all players that the particular player 30 or 40 has been shot and continues to remain vulnerable since his gun 50 is temporarily inoperative. A timer 210 provides an input to flip-flop 206 for controlling the pulse duration of stun LEDs 64. After, for example, ten seconds, the STUN ID signal (FIG. 7) will be transmitted to flip-flop 202 to turn off STUN LEDS 64 and turn on team LEDS 66. Flip-flop 206 will be reset via signal line 212 to cause stun LEDs 64 to turn off and team LEDs 66 to again be illuminated.

FIG. 6 also illustrates the infrared LEDs 54 which are driven by transistors 214, 216 and 218. Transistors 214, 216 and 218 receive the IR (XMIT) signal generated by infrared transmitter 160 (FIG. 4).

Figure 7:
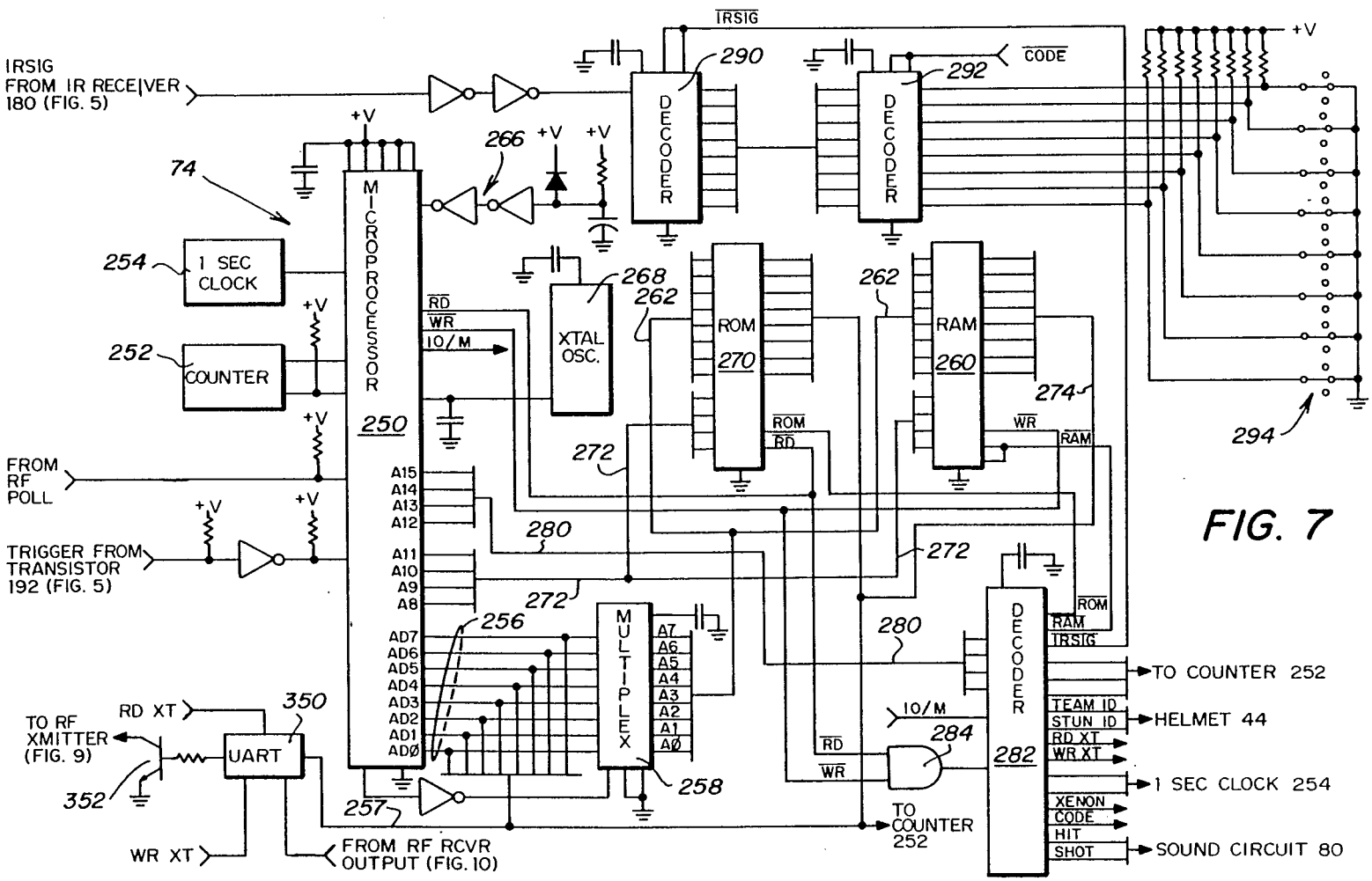
FIG. 7 is a schematic diagram of the vest processor circuitry.

Referring now to FIG. 7, the electronic circuitry representing microprocessor control circuit 74 of vest module 46 (FIG. 2) is illustrated. Microprocessor control circuit 74 includes a microprocessor 250. An interrupt signal is applied to microprocessor 250 from the optointerrupter circuit 188 of gun 50 in the form of the TRIGGER SIGNAL. Microprocessor 250 also receives an interrupt signal from the RF transmit circuit in the form of the RF POLL signal. An additional interrupt to microprocessor 250 is generated by a counter 252. Counter 252 counts down from 25.4 milliseconds at 0.1 millisecond intervals. When the counter reaches 0, an interrupt is generated to microprocessor 250.

An additional interrupt is provided to microprocessor 250 by a one second clock 254. One second clock 254 operates as a real time clock for generating the ten second count during which time a shot player 30 or 40 is vulnerable due to his gun 50 being inoperative, controlling the number of shots per second, for example, twenty shots in sixty seconds, and the amount of time which must elapse before a player can reshoot the same player in succession, for example, 15 seconds.

Microprocessor 250 includes a standard address data bus, the lower eight bits 256 are multiplexed by a multiplexer 258 with the data bus of a random access memory (RAM) 260 to provide output data to RAM 260 via signal line 262.

Microprocessor 250 includes reset circuitry generally identified by the numeral 266 and a crystal oscillator 268 which operates at, for example, 2.4576 MHz.

A read only memory (ROM) 270 is interconnected to multiplexer 258 via signal line 262 and to microprocessor 250 via signal line 272. ROM 270 may comprise for example, a 4K by 8 bit read only memory, such a 2732 I/C. Random access memory 260 is interconnected to microprocessor 250 via signal line 272 and to multiplexer 258 via signal line 274. RAM 260 may comprise, for example, a 2K by 8 bit memory, such as a 5516 I/C. Microprocessor 250 is interconnected via signal line 280 to a 4515 I/C decoder 282. ROM 270 receives the read ($\overline{RD}$) signal from microprocessor 250 and RAM 260 receives the write ($\overline{WR}$) signal from microprocessor 250 which are applied through an AND circuit 284 to decoder 282.

The IRSIG signal from gun 50 which represents a received infrared signal from a player 30 or 40 is applied to a decoder 290 which is interconnected to a decoder 292. Decoder 292 is interconnected to switches 294 which represent, in binary, the player's code, vest code, which will be transmitted to game computer 110 (FIG. 3).

Decoder 282 generates the ROM signal applied to ROM 270 and RAM signal applied to RAM 260. Decoder 282 further generates the $\overline{IRSIG}$to enable decoder 290 to read the IRSIG signal. Decoder 282 further generates signals to counter 252 to load counter 252 with a preset number to begin the point of countdown. Decoder 282 further generates the TEAM ID and STUN ID signals to helmet 44 which are applied to flip-flop 202 (FIG. 6). Enable and disable signals are generated by decoder 282 which are applied to the one second clock 254. The XENON signal generated by decoder 282 is applied to the xenon flash circuitry of gun 50 to enable gun 50 to flash when actuated. The CODE signal generated by decoder 282 is applied to decoder 292 to enable microprocessor control circuit 74 to read the particular code of a vest module 46. The HIT and SHOT signals generated by decoder 282 are applied to sound generation circuitry 80 of vest module 46 to generate the sounds associated with a shot when the trigger 60 of gun 50 is actuated and when a player is shot.

Decoder 282 further generates the RD XT and WR XT signals which are applied to a Universal Asynchronous Receiver Transmitter (UART) device 350. UART 350 functions as an interface between microprocessor 250 and RF link 76 (FIG. 2) and may comprise, for example, a 2502 or a COM 2017 integrated circuit. UART 350 receives the lower eight bits of the address data bus of microprocessor 250 via signal line 257. UART 350 further receives as an input the output from the RF receiver of RF link 76, to be subsequently described with respect to FIG. 10. UART 350 generates an output via a transistor 352 to the RF transmitter of RF link 76, to be subsequently described with respect to FIG. 9. The RD XT signal controls UART 350 such that data is read into microprocessor 250 from the RF receiver. The WR XT signal controls UART 350 such that data is written from microprocessor 250 to the RF transmitter of RF link 76.

Figure 8:
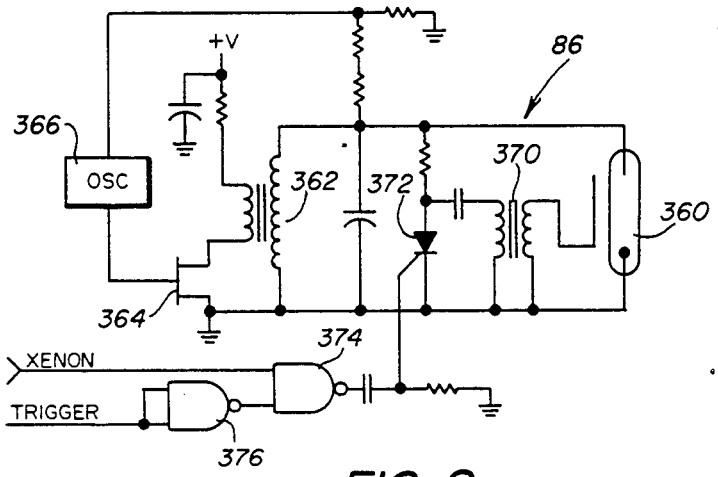
FIG. 8 is a schematic diagram of the gun xenon flash circuitry.

Referring now to FIG. 8, a schematic diagram of the gun xenon flash circuit 86 (FIG. 2) is illustrated. Xenon flash circuit 86 includes a xenon flash tube 360 which is charged to its firing voltage utilizing a transformer 362. The primary winding of transformer 362 is interconnected to a transistor 364 which may comprise, for example, a power MOSFET. Transistor 364 is interconnected to an oscillator 366 which functions to control the change of voltage across transformer 362 in order to charge xenon flash tube 360.

Xenon flash tube 360 is also interconnected to a transformer 370 which functions to discharge xenon flash tube 360 to generate the flash of light 84 (FIG. 1). Transformer 370 is interconnected to a silicon controlled rectifier (SCR) 372 which when actuated controls the discharge of xenon flash tube 360 through transformer 370. Actuation of SCR 372 is controlled by a signal on the gate terminal which is interconnected to an AND gate 374. One terminal of AND gate 374 receives the XENON signal generated by decoder 282 (FIG. 7). The second input to AND gate 374 is received from an AND gate 376 which receives the TRIGGER signal (FIG. 5) generated when trigger 60 of gun 50 is pulled by a player 30 or 40.

In operation of xenon flash circuit 86, when the TRIGGER signal is generated by pulling trigger 60 of gun 50, this signal is applied to microprocessor 250 (FIG. 7) and to AND gate 376. If the trigger pull is proper, that is, a player 30 or 40 has not exceeded the allowed number of shots within a predetermined time period, microprocessor 250 will generate the XENON signal via decoder 282 (FIG. 7) to cause AND gate 374 to actuate SCR 372 thereby discharging xenon flash tube 360 to emit flash of light 84 (FIG. 1). Flash of light 84 will only be emitted by gun 50 when a player 30 or 40 has not exceeded the allowed predetermined number of shots within a given time period.

Referring now to FIG. 9, a schematic diagram of the RF link 76 (FIG. 2) within vest module 46 is illustrated. RF link 76 includes a tuned circuit 380. Tuned circuit 380 includes inductors 382 and 384 and a variable capacitor 386 for tuning tuned circuit 380. Tuned circuit 380 is coupled to a transistor 388 which together with capacitors 390, 392 and 394 and a resistor 396 form an oscillator circuit for the transmitter of RF link 76. The RF transmitter of FIG. 9 may operate at a frequency of, for example, 300 MHz. The input to tuned circuit 380 is provided from UART 350 through transistor 352 (FIG. 7).

Figure 10:
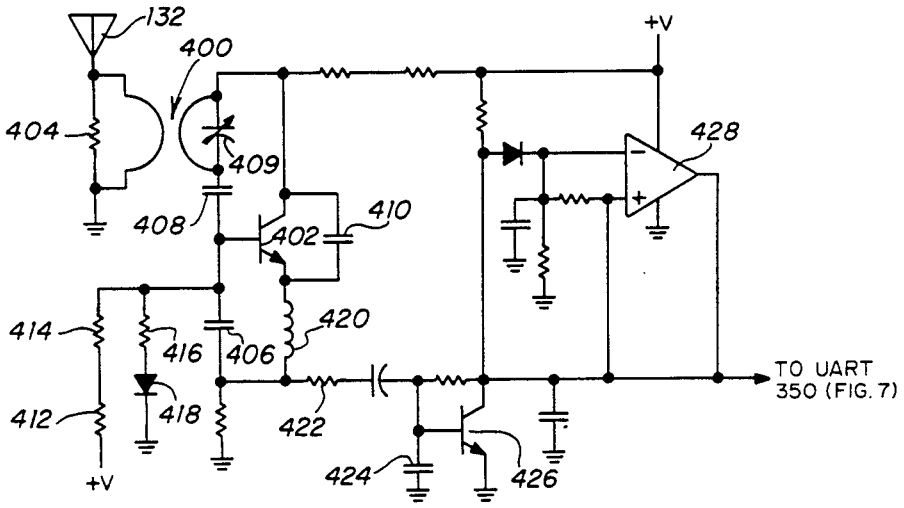
FIG. 10 is a schematic diagram of the RF receive circuitry.

Referring now to FIG. 10, the RF receiver circuitry associated with RF link 76 is illustrated. Antenna 132 (FIG. 3) is interconnected through a transformer 400 to the tuning tank of a super-regenerative detector 402. A resistor 404 provides a stabilizing shunt to the primary of transformer 400 and negates the detuning effects that may occur from variations in the loading of antenna 132. Super-regenerative detector 402 operates as self-quenching oscillator responding logarithmically to the signal-amplitude at the moment oscillation begins. To reduce radiant energy from super-regenerative detector 402, the primary feedback path for the oscillator composed of super-regenerative detector 402, and capacitors 406, 408 and 409 is provided by a capacitor 410. Capacitor 409 is used for tuning purposes The input biasing network for super-regenerative detector 402 is provided through resistors 412, 414 and 416. A diode 418 is provided in the input biasing circuit for temperature stability purposes The detected signal from super-regenerative detector 402 is RF decoupled through inductor 420 and is low-pass filtered by a resistor 422 and a capacitor 424. The detected signal is amplified by a transistor 426. The output of transistor 426 is applied to a Schmidt trigger 428. The output of Schmidt trigger 428 is applied to UART 350 (FIG. 7). Schmidt trigger 428 provides a saturated output state change when the input amplitude is sufficient to reverse the polarity of the inputs to Schmidt trigger 428.

Figure 11:
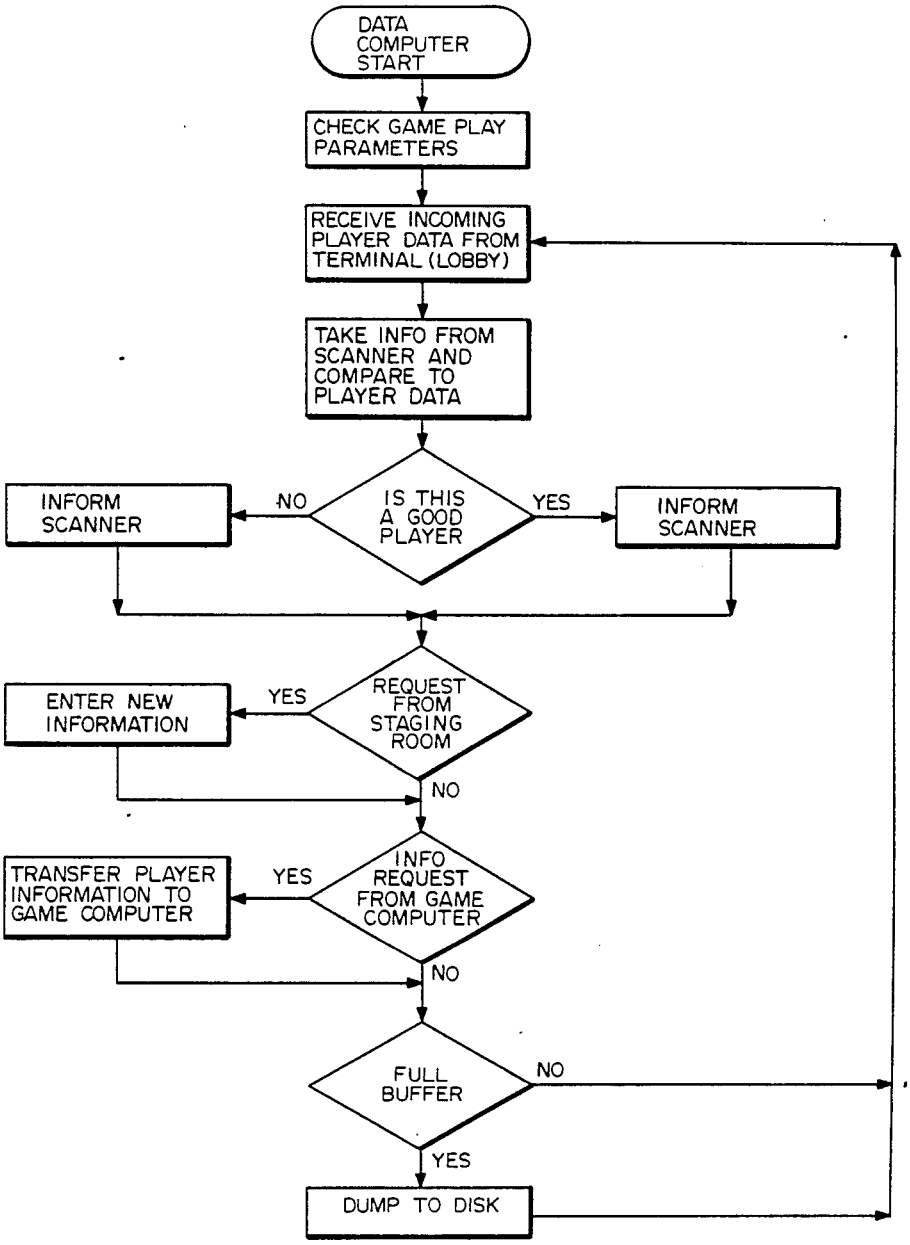
FIG. 11 is a computer flow diagram illustrating the operation of the software associated with the data computer of the present amusement game.

Referring to FIG. 11, a flow diagram of the computer software associated with data computer 100 (FIG. 3) will now be described. The data computer 100 begins by checking the game play parameters which include points for the game format relating to the number of points awarded for shooting an enemy player, shooting the target of the opposing team and point reductions. Additionally, game parameters include the number of shots which can be fired in a time interval. Data computer 100 next receives incoming player data from terminal 102, the incoming player data input from card reader 104 is then compared to the player data from terminal 102. A decision is then made to determine whether the input data reflects that of a good player which is entered from the lobby area to the staging room where card reader 104 is located adjacent battlefield 10 (FIG. 1). If data computer 100 determines that the information is incorrect, card reader 104 will be informed by illuminating a visual light in the staging room to inform the operator of card reader 104 that data has been incorrectly entered. If the player information is correct, a different type of visual indication will be presented to the operator of card reader 104.

A determination is then made whether there is a request from the staging room input terminal 106 for any data correction. If such a request is made, new information is entered. If no request is made, a determination is made as to whether there has been an information request from game computer 110 (FIG. 3). If a request for information from game computer 110 has been made, the information stored in data computer 100 as to the players playing the particular game is transferred to the game computer 110. The player information is continuously transferred to game computer 110. A decision is then made as to whether the memory of data computer 100 is filled. If the memory buffer is full, the data will be transferred to game computer 110. If the memory buffer is not full, the computer flow returns to receiving incoming player data from the lobby terminal 102. When data for all players has been received, terminal 106 a message to game computer 110, game computer sends a "ready" signal back to terminal 106 and terminal 106 sends a "start" signal to game computer 110.

Figure 12A:
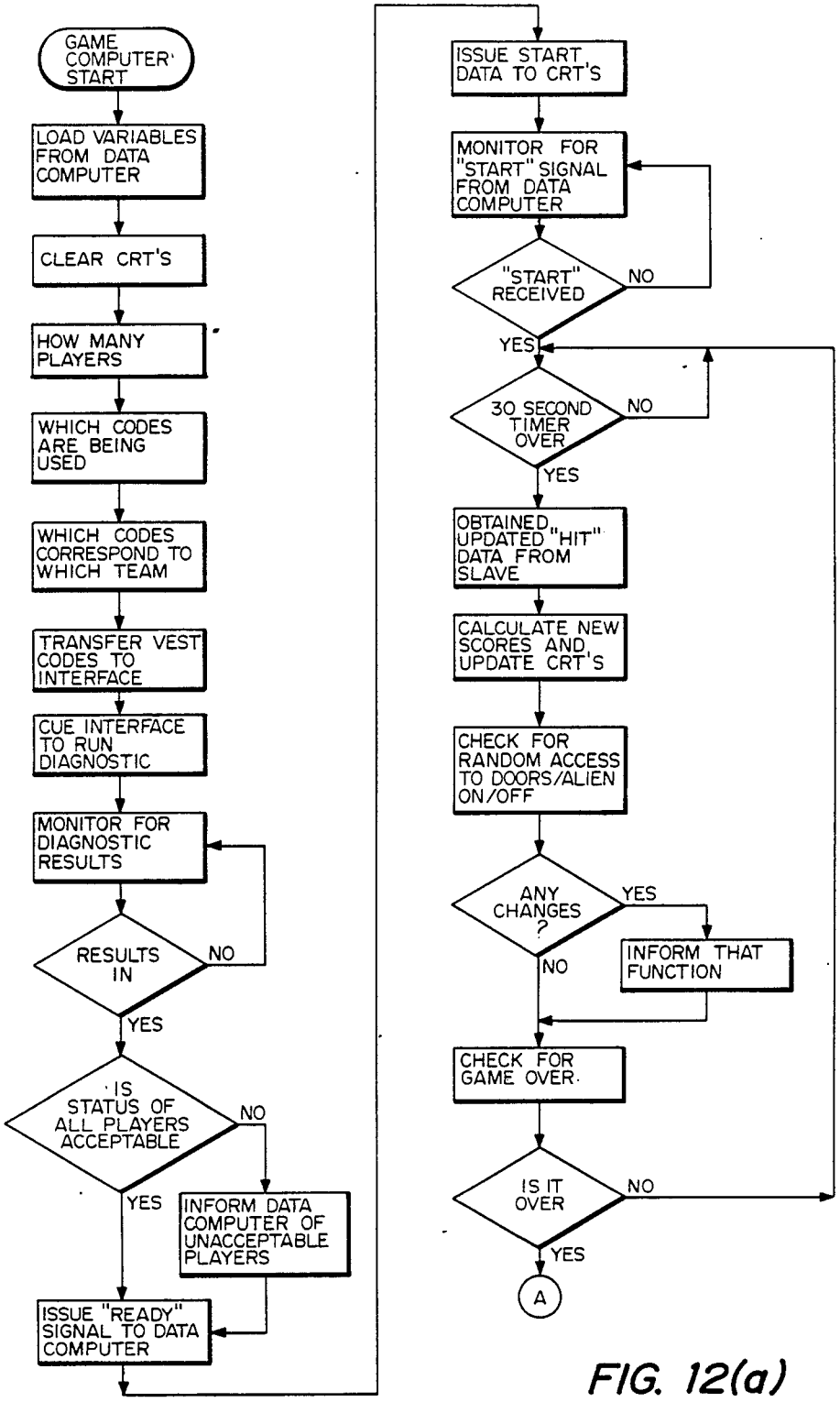
FIGS. 12(*a*) and 12(*b*) are computer flow diagrams illustrating the operation of the game computer.
Figure 12B:
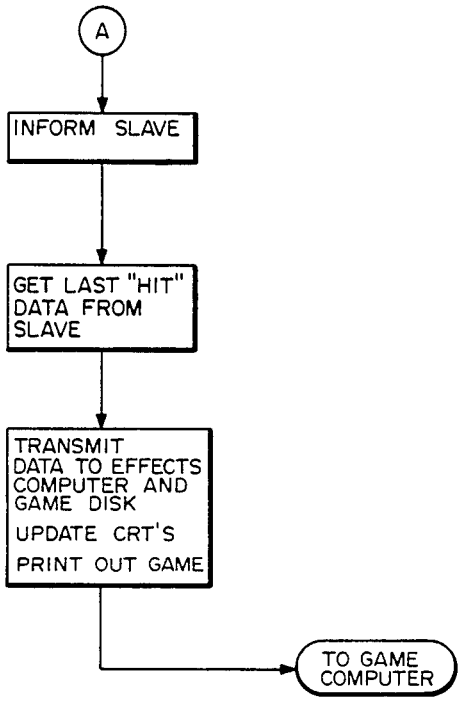

Referring now to FIGS. 12(*a*) and 12(*b*), a flow diagram representing the computer program associated with game computer 110 is illustrated. Initially, variables from data computer 100 will be loaded. As previously stated, these variables include the points for each shot and time durations involved in the play of the present game. The scoreboard displays 122 will be cleared, player information from the data computer such as, the number of players playing the particular game will be transferred in addition to the vest module 46 codes being used with each player. Game computer 110 will then determine which codes correspond to which team and will transfer the vest module 46 codes to interface computer 126.

Game computer 110 then will queue interface computer 126 to run its diagnostic routine on the players by polling each player before the start of the game. In this manner, communication between each player and interface computer 126 can be verified. Game computer 110 determines whether the diagnostic results have been compiled and completed. If the diagnostic results have been finished, a decision is made as to whether the status of all players is acceptable. If the decision is no, the data computer 100 will be informed of unacceptable players. A condition of unacceptability may involve a determination that a player's personal equipment 42 is defective or player identification information is incorrect. If the status of all players is acceptable, a ready signal will be transferred to interface computer 126, and data computer 100 (FIG. 3) and start data will be issued to scoreboard 122.

Once the operator observes the ready condition (FIG. 3), he must inform game computer 110 via terminal 106 (FIG. 3) before the game can begin. Game computer 110 monitors to determine whether the start signal has been generated by the operator by monitoring the output of data computer 100. The monitoring continues until the start signal generated by terminal 106 has been received. Once the start signal has been received by game computer 110, there is a delay, for example, 30 seconds before the game begins. At the expiration of 30 seconds, game computer 110 obtains updated hit data from interface computer 126 and calculates new scores for each of the players 30 and 40 and presents the updated scores to the scoreboard 122.

Game computer 110 then checks for whether it is time to actuate a door 22 (FIG. 1) or an alien 134 or 136 (FIG. 3). If there are any changes to be made in the present status of a door or alien, that particular function will be informed. Game computer 110 then determines whether the particular game being played is over. If the game is not over, the flow returns to allow game computer 110 to again update hit data from interface computer 126. If the game is over, the flow diagram continues via page connector A to FIG. 12(*b*) and game computer 110 informs interface computer 126 and obtains the last hit data from interface computer 126. This data is then transmitted to the effects computer 114 to allow effects computer to transfer this data to printer 118, the past game score monitor 116, and the game data disk 112.

Figure 13A:
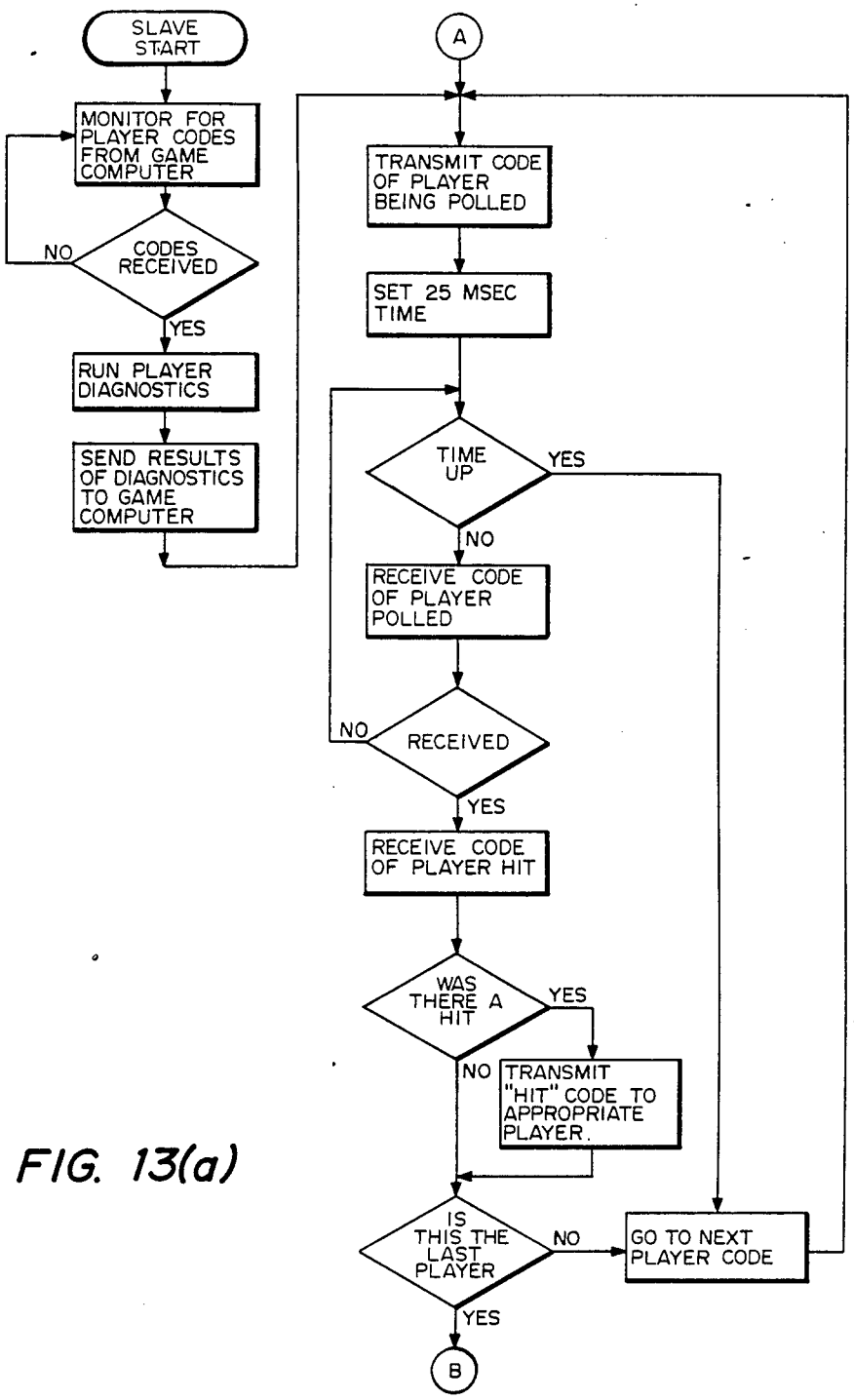
FIGS. 13(*a*) and 13(*b*) are computer flow diagrams illustrating the operation of the interface computer.
Figure 13B:
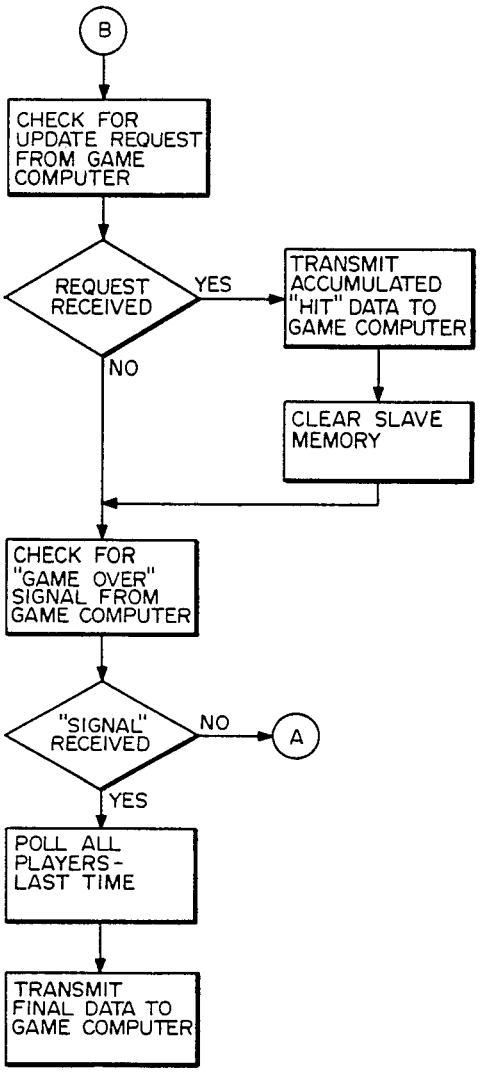

Referring now to FIGS. 13 (*a*) and 13(*b*), a computer flow diagram for the computer software associated with interface or slave computer 126 is illustrated. Interface computer 126 initially monitors the player's codes from game computer 110. After all codes have been received for the players playing a particular game, interface computer 126 performs a diagnostics routine and sends the results of the diagnostics routine to game computer 110.

The polling of a player will continue for 25 milliseconds. During the 25 milliseconds, interface computer 126 will continue to monitor for the code of the player being polled. Initially, interface computer 126 will transmit a player code and monitor for the receipt of the player code during the polling time. If the particular player's code transmitted is not received back to interface computer 126 within the 25 millisecond time interval, interface computer 126 will then go to the next player's code and transmit that code for monitoring.

If the code of the player polled has been received, the player will then transmit the code of any player hit. Determination is made as to whether a player was shot, and if so, a "hit" code is transmitted to the appropriate shot player, thereby notifying the player that he has been shot. The polling process looks to each player for a period of, for example, 25 milliseconds such that all players are polled within a short period of time.

If no code is received that any enemy player has been hit, the polled player will transmit a zero code back to interface computer 126 in order to confirm that communication exists between the polled player and interface computer 126. If no code is received from the polled player, for several attempts, interface computer 126 will notify game computer 110 of this lack of communication to allow the particular player to play the game again since there was a malfunction in his personal equipment 42.

A determination is then made whether the polled player was the last player. If the decision is no, interface computer 126 will then send an interrogation pulse to the next player. If the decision is that the player polled was the last player, the flow diagram continues via page connector B to FIG. 13(*b*) and interface computer 126 then checks for an update request from game computer 110. If the receive request is received, interface computer 126 will transmit the accumulated "hit" data to game computer 110. Interface computer 126 will then clear its memory and monitor for the "game over" signal from game computer 110. If the game over signal has not been received, interface computer 126 will again poll all players for hit information and the flow diagram returns via page connector A to FIG. 13(*a*). If the game over signal has been received, all players are polled for the last time and the final data is transmitted to game computer 110.

Figure 14A:
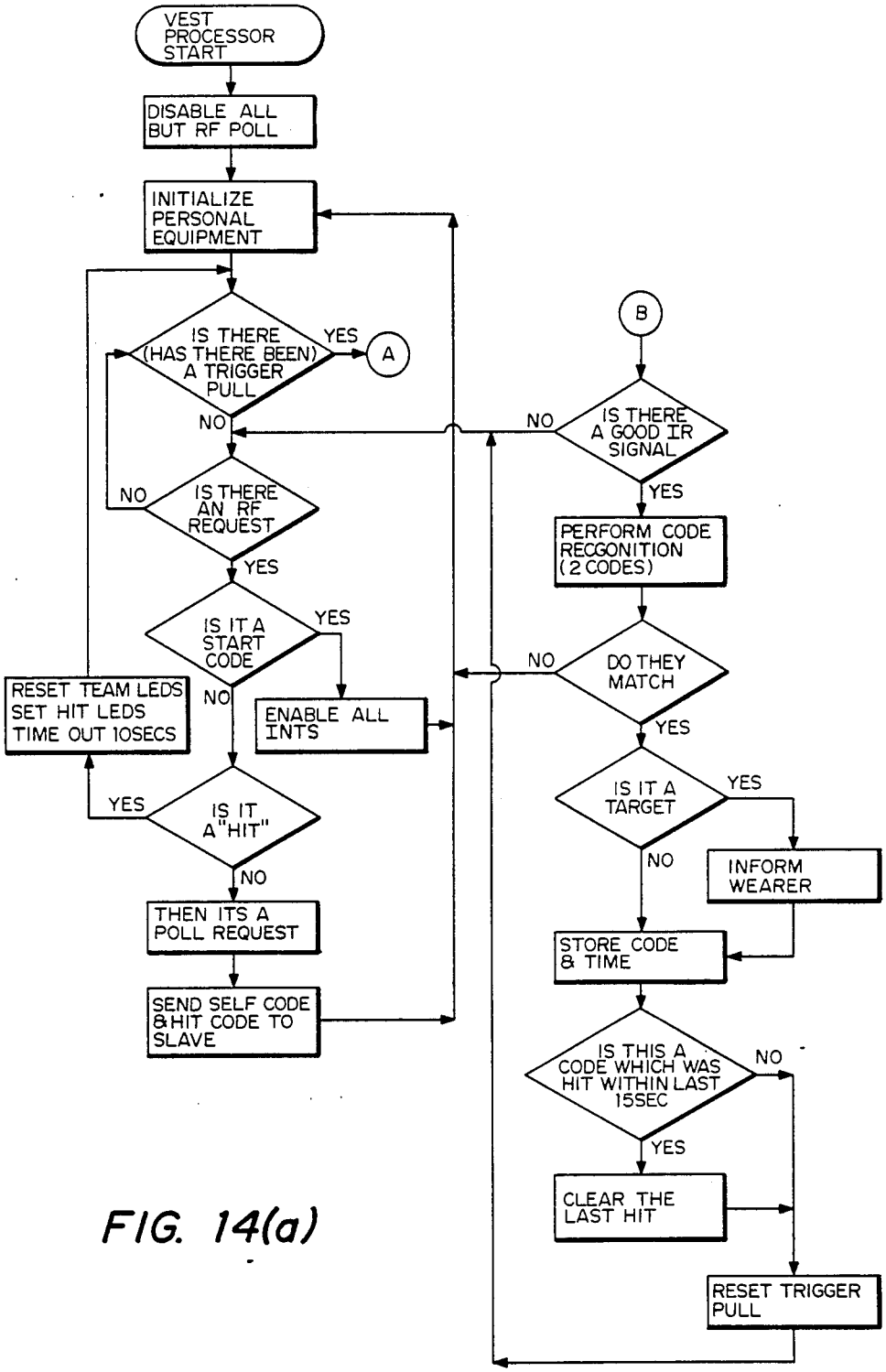
FIGS. 14(*a*) and 14(*b*) are computer flow diagrams illustrating the operation of the vest processor computer associated with the amusement game of the present invention.
Figure 14B:
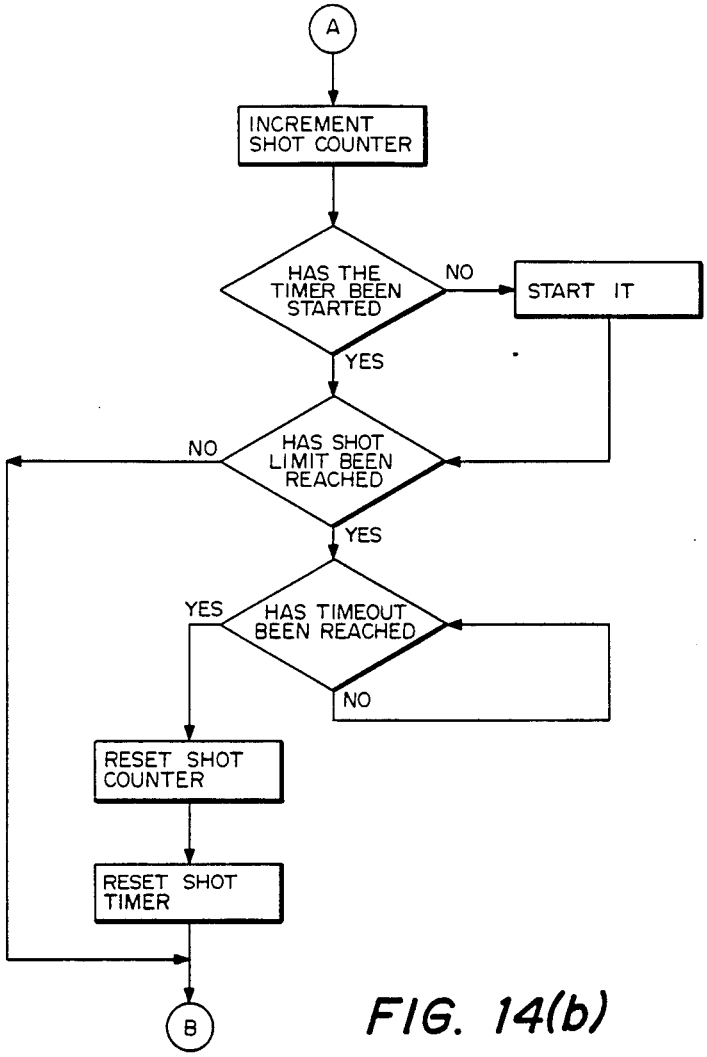

Referring now to FIGS. 14(*a*) and 14(*b*), a flow diagram for the computer software associated with vest module 46 microprocessor 250 (FIG. 7) is illustrated. Initially, all interrupts are disabled except for the RF poll interrupt. Interface computer 126 is part of the diagnostics program (FIG. 13) and will poll microprocessor 250 with a self code and receive back a zero code indicating proper operation of microprocessor control 74 (FIG. 2). The personal equipment 42 will not be initialized until an RF request has been received by microprocessor 250. If the request is a start code all other interrupts will be enabled and the personal equipment 42 will be initialized.

After the personal equipment 42 has been initialized, microprocessor 250 determines whether there has been a trigger 60 pull of gun 50. If the decision is that there has been no trigger 60 pull of gun 50, a determination will be made as to whether there has been an RF request by interface computer 126. If such a request has been made, it is now not a start code request since the personal equipment 42 has now been initialized, a decision is then made as to whether the request is a "hit".

If the transmitted information is a "hit", team LEDs 66 (FIG. 2) will be turned off, stun LEDs 64 will be illuminated and the ten second timer will be actuated. At the end of ten seconds, the flow returns to the decision block to determine whether the trigger 60 of gun 50 has been pulled. If the decision were that there was no "hit", the request must be that of a poll request and the self code and the hit code is transmitted to interface computer 126 then the flow returns to reinitialize all personal equipment 42.

If a decision had been made that the trigger 60 of gun 50 was pulled, the flow diagram continues via page connector A to FIG. 14(*b*). Referring now to FIG. 14(*b*), the shot counter will be incremented by one shot. A determination is then made as to whether the shot timer has been started. If the decision has been no, the shot timer will be started and a determination will then be made as to whether the shot limit has been reached. If the shot limit has been reached, a determination will be made as to whether the shot timer has been timed out. If the timer has not been timed out, the timer will continue to run until the expiration of 60 seconds. At the end of 60 seconds, the shot counter will be reset, the shot timer will be reset and the flow returns via page connector B to FIG. 14(*a*). If the shot limit had not been reached, the flow also returns via page connector B to FIG. 14(*a*).

Referring again to FIG. 14(*a*) at page connector B, a determination is then made as to whether there is a good infrared signal being detected by IR receiver 58 of gun 50. If the signal is not a good infrared signal, the signal is rejected and the flow returns to the program as shown in FIG. 14(*a*). If the code is good, the code recognition sequence is performed to determine if a match exists between the code received and a code being used by a player in the game. If the codes do not match, personal equipment is again initialized.

If the codes do match, a decision is made as to whether the code is the target of the enemy player. If the decision is yes, the player who has hit the target will be informed with an audio sound from speaker 72 generated by sound generation circuitry 80 within vest module 46 that he has hit an enemy player 30 or 40.

If the codes do match and it is the code of an enemy player, the hit code and the time at which the hit occurred are then stored. A determination is then made as to whether this player had been hit within the last 15 seconds. If the decision is yes, the last hit will be cleared from the score of the shooting player. In this manner, a player 30 or 40 cannot receive credit for sequential hits on the same enemy player. If a no decision has been reached, indicating that the player was not consecutively hit, the trigger 60 pull circuitry of gun 50 will be reset and the flow diagram returns to determine whether there has been an RF request.

It therefore can be seen that the present amusement game provides for an action packed exciting game providing much entertainment for the game players. The shooting game of the present invention allows each player to compile his own score against enemy players while defending himself on the battlefield. The game of the present invention offers the players numerous challenges and effectively puts the player into the action of an audio visual game.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. An amusement shooting game for play by a plurality of players, wherein players shoot at each other while being shot at on a battlefield comprising:

means carried by each player for generating and transmitting continuously in a wide-angle beam directed outwardly from each player a coded signal unique to each player;

means carried by each player for receiving said transmitted coded signal being transmitted by all of the players, said means for receiving having a reception angle substantially smaller than said wide-angle beam;

means responsive to said receiving means for detecting a transmitted coded signal; and means for counting the number of detected coded signals to provide a score for each player representing the number of players he has shot.

2. The amusement shooting game of claim 1 further including:

hit means associated with each player for indicating to a player that his transmitted coded signal has been detected by another player.

3. The amusement shooting game of claim 2 wherein said hit means includes:

a helmet worn by each player; and means for generating audio sounds in said helmet.

4. The amusement shooting game of claim 3 wherein said hit means includes:

means for generating a visual display on said helmet.

5. The amusement shooting game of claim 2 wherein said hit means includes:

means for preventing operation of said receiving means for a predetermined time period.

6. The amusement shooting game of claim 1 further including:

sight means associated with each player for indicating to a player that he has received a transmitted coded signal, transmitted by another player.

7. The amusement shooting game of claim 6 wherein said sight means includes:

means for generating a visual display to the shooting player.

8. The amusement shooting game of claim 1 wherein said means for generating and transmitting said coded signals includes:

a plurality of infrared light emitting diodes mounted to a helmet worn by each player.

9. The amusement shooting game of claim 1 wherein said means for receiving said transmitted coded signals includes:

gun means carried by each player, said gun means including trigger means such that said means for receiving is actuated when said trigger means is operated.

10. The amusement shooting game of claim 9 and further including:

means for preventing operation of said trigger means when a player has been shot.

11. The amusement shooting game of claim 1 and further including:

means for preventing a player from repeatedly shooting another player within a predetermined time period.

12. The amusement shooting game of claim 1 wherein the battlefield includes obstacles for preventing the free movement of a player.

13. The amusement shooting game of claim 12 wherein said obstacles include:

means for shooting at all the players for decreasing the players' scores.

14. The amusement shooting game of claim 12 wherein said obstacles include:

passageways which are periodically opened and closed to provide hiding places for the players.

15. The amusement shooting game of claim 12 wherein the battlefield further includes:

targets for being shot at by all the players for increasing the players' score.

16. An amusement shooting game for play by a plurality of players wherein the players shoot at each other while avoiding being shot at on a battlefield including:

vest means carried by each player for generating a continuous coded signal uniquely identifying each player;

helmet means worn by each player for transmitting said continuous unique coded signal in a wide angle beam directed outward from each player;

gun means carried by each player and having a trigger, said gun means for receiving said unique coded signals when said trigger is actuated, said gun means having a reception angle substantially smaller than said wide angle beam; and data processing means for generating a score for each player indicative of the number of players that each player has shot.

17. The amusement shooting game of claim 16 wherein said data processing means further includes:

means for generating signals to a player indicating that the player has been shot.

18. The amusement shooting game of claim 16 wherein said data processing means further includes:

means for generating signals to each player indicating that the player has been shot by another player.

19. The amusement shooting game of claim 16 wherein said unique coded signals include infrared coded signals.

20. The amusement shooting game of claim 16 wherein said data processing means further includes:

means for preventing operation of a player's gun means for a predetermined time when the player has been shot.

21. An amusement shooting game for play by a plurality of players, wherein the players shoot at each other while avoiding being shot at on a battlefield, each of the players having personal equipment including a helmet, vest and gun, the game comprising:

means housed in the player's vest for generating a continuous code uniquely identifying the player;

means connected to the player's vest for receiving said continuous code and mounted to the player's helmet for transmitting said continuous code in the form of a wide angle infrared beam directed outward from the player;

means including a trigger mounted in the player's gun for receiving infrared beams transmitted by the other players, said means for receiving having a reception angle substantially smaller than said wide angle beam;

means mounted to the player's gun and connected to the player's vest for detecting a received, coded infrared beam upon actuation of the gun;

transmitting means housed in the player's vest for transmitting information related to received, coded infrared beams to a data processing unit;

said data processing unit including means for receiving said transmitted data from said transmitting means for calculating a score for each player based upon the number of players he has shot and the number of times he has been shot by other players; and said data processing unit further including means for transmitting data to each player to provide an indication whether the player has been shot or has shot another player.

22. The amusement shooting game of claim 21 wherein said data processing unit includes:

means for preventing operation of a player's gun for a predetermined time period when the player has been shot.

23. The amusement shooting game of claim 21 wherein each player's gun includes means for generating a light beam upon actuation of said gun trigger.

24. The amusement shooting game of claim 23 wherein the player's gun includes: means for indicating to the player that he is receiving an infrared code transmitted by another player.

25. The amusement shooting game of claim 21 wherein each player's helmet includes:

sound generation means for producing battlefield sounds and sounds indicating that the player has been shot.

26. The amusement shooting game of claim 25 wherein the player's helmet includes:

display means indicating that the player has been shot.

27. The amusement shooting game of claim 21 wherein said processing unit further includes:

means for calculating the score for each player based upon nonconsecutive shooting of another player.

28. The amusement shooting game of claim 21 wherein the battlefield includes obstacles for preventing the free movement of a player.

29. The amusement shooting game of claim 28 wherein the battlefield includes targets for being shot at by all the players for increasing the players' score.

30. The amusement shooting game of claim 21 and further including:

power supply means for generating power to the player's helmet, vest and gun, said power supply means being worn as a belt by the players.

31. An amusement shooting game for play by a plurality of players, wherein the players shoot at each other while avoiding being shot at on a battlefield:

means carried by each player for continuously generating a unique, repeated, coded signal to identify the player, means carried by each player and connected to receive said coded signal for generating an infrared beam modulated by said coded signal thereby producing a coded infrared beam, said beam transmitted outward as a wide angle beam from the player, means carried by each player for receiving the infrared beams generated by the other players, said means for receiving having a reception angle substantially smaller than said wide angle beam, a transmitter carried by each player and connected to said means for receiving the infrared beams for transmitting a hit signal when said means for receiving the infrared beams receives one of said infrared beams generated by another of said players, said hit signal coded to identify the unique coded infrared beam received by the means for receiving the infrared beams, a receiver for receiving said hit signals from said transmitters carried by said players, processing means connected to said receiver for maintaining a score for each of said players and for generating a hit received signal in response to each said hit signal received at said processing means, a transmitter connected to said processing means for transmitting said hit received signals, receiving means carried by each player for receiving said hit received signals from said transmitter wherein said hit received signal is received by the one player whose coded infrared beam has been intercepted by another player's means for receiving the infrared beams, and means carried by each player for generating a hit indication signal to the player upon receipt of said hit received signal.

* * * * *